US005809876A

United States Patent [19]

Thompson

[11] Patent Number: 5,809,876

[45] Date of Patent: Sep. 22, 1998

[54] HOT STAMP IMPRINTING SYSTEM WITH VARIABLE TYPEHOLDER

[75] Inventor: James A. Thompson, Downers Grove, Ill.

[73] Assignee: Illinois Tool Works Inc., Glenview, Ill.

[21] Appl. No.: 725,929

[22] Filed: Oct. 7, 1996

[51] Int. Cl.[6] ..... B44B 5/02

[52] U.S. Cl. ..... 101/31; 101/28; 101/394

[58] Field of Search ..... 101/15, 28, 368, 101/370, 377, 379, 380, 381, 386, 390, 391, 392, 393, 394, 31; 199/6; 276/40, 41, 42, 43

[56] References Cited

U.S. PATENT DOCUMENTS

| | | | |
|---|---|---|---|
| 879,462 | 2/1908 | Green | 101/31 |
| 1,062,283 | 5/1913 | Kohnle | 101/381 |
| 1,584,643 | 5/1926 | Pannier et al. | 101/28 |
| 1,769,583 | 7/1930 | Lamb et al. | 101/381 |
| 2,009,414 | 7/1935 | Roberts, Jr. | 101/381 |
| 2,147,480 | 2/1939 | Beckert | 101/28 |
| 2,317,861 | 4/1943 | Speicher et al. | 101/381 |
| 2,663,252 | 12/1953 | Kingsley | 101/31 |
| 2,670,677 | 3/1954 | Hauer | 101/28 |
| 2,740,352 | 4/1956 | Kingsley | 101/31 |

FOREIGN PATENT DOCUMENTS

| | | | |
|---|---|---|---|
| 235301 | 9/1960 | Australia | 101/28 |
| 2663883 | 1/1992 | France | 101/28 |
| 24 35 070 | 2/1976 | Germany | 101/28 |

*Primary Examiner*—Edgar S. Burr
*Assistant Examiner*—Leslie Grohusky
*Attorney, Agent, or Firm*—John P. O'Brien

[57] ABSTRACT

An imprinting system having a print head with a plurality of type for transferring ink from an inked ribbon onto a substrate. A typeholder having an open ended cavity defined by side walls for retaining the plurality of type, wherein the typeholder is removably disposeable in a recess of the print head. At least one side wall portion of the cavity is removably coupleable to the typeholder for permitting insertion and removal of the plurality of type into and from the cavity. And a resilient member protrudes into the cavity from at least one of the side walls, wherein the resilient member biases the plurality of type toward one of other the side walls to prevent shifting of the type in the cavity. A resilient member urges a button protruding from an outer surface of the typeholder into contact with the recess of the print head, and a magnetized striker plate disposed on another outer surface of the typeholder cooperates to securely retain the typeholder in the recess of the print head.

11 Claims, 1 Drawing Sheet

HOT STAMP IMPRINTING SYSTEM WITH VARIABLE TYPEHOLDER

CROSS-REFERENCE TO RELATED APPLICATIONS

The present application is related to the following several co-pending application U.S. application Ser. No. 08/725,932, filed 7 Oct. 1996 and entitled "Hot Stamp Imprinting System With Backup Pad Assembly", U.S. application Ser. No. 08/725,930, filed 7 Oct. 1996 and entitled "Hot Stamp Imprinting System With Locking Cam Reel Hubs", and U.S. application Ser. No. 08/725,928, filed 7 Oct. 1996 and entitled "Hot Stamp Imprinting System With Latchable Ink Ribbon Cassette and Handle", all assigned to the common assignee of the present invention and incorporated herein by reference.

BACKGROUND OF THE INVENTION

The invention relates generally to printing systems, and more particularly to hot stamp imprinters having a print head having a variable removably coupled typeface for transferring ink from an inked ribbon onto a substrate.

Hot stamp imprinting systems are used often by the packaging industry in labeling and packaging production lines to produce high quality imprints of lot numbers, expiration dates, production codes, and other variable information on a variety of substrates including labels and packages. Hot stamp imprinter systems include generally an inked ribbon disposed between a backup pad and a heated print head assembly. The print head assembly usually includes a typeholder with a typeface having alpha-numeric characters and logos, which is movable toward and away from the back-up pad by a cam or pneumatic actuator mechanism to transfer ink onto a portion of substrate between the inked ribbon and the backup pad. Between imprints, the inked ribbon is advanced from a ribbon supply roll to a ribbon take-up roll to position an unused portion of inked ribbon between the print head assembly and the back-up pad for the next imprint. The substrate is also advanced between imprints by a substrate feed mechanism to position an adjacent portion of the substrate between the print head and the backup pad for the next imprint.

Typeholders generally include an open ended cavity for receiving one or more series of type each having a character, or logo, or blank typeface, which protrudes from the open end of the cavity. The cavity of the typeholder is usually defined by four side walls and a base forming a rectangular opening. One or more side walls of the typeholder may be disassembled to permit arranging and changing, or setting, the type. The type has a rectangular sectional shape, and is adjacently arranged side by side in the cavity. The type also has a protruding foot portion interlockingly engageable with a recess along one of the cavity side walls to prevent the type from separating from the base of the typeholder. And any voids between the type and the cavity walls are filled with various size spacers also having foot portions interlockably engageable with the type. The type and spacers are thus retained in the cavity by the foot portions, and the assembled cavity walls retain the type and spacers therebetween. The type and spacers, however, have a tendency to shift within the cavity in all directions resulting in inaccurate and inconsistent ink transfer onto the substrate. This shifting moreover tends to increase over time as a result of wear on the type, spacers, and cavity walls, which shifting degrades or adversely affects imprint quality.

In many applications, the typeholder is removably disposed in a heater block portion of the actuatable print head, which facilitates ready disassembly of the typeholder and revision of the typeface, or typesetting. The heater block, however, usually requires some tools and disassembly to remove and install the typeholder, which is undesirable. Additionally, the typeholder is usually fabricated from a metal like brass whereas the heater block is usually fabricated from a lightweight metal like aluminium. These various materials, however, have different heat expansion coefficients, which result in the typeholder being loosely retained in the heater block. And a loosely retained typeholder, similar to the shifting type discussed above, adversely affects imprint quality. Other factors including wear between the typeholder and the heater block also adversely affect retention of the typeholder in the heater block, which further degrades imprint quality.

The necessity of high quality, consistently accurate imprinting is especially significant in many applications including the pharmaceutical industry where imprinted product codes, lot numbers and other data must be accurately recorded by automated imaging, or computer controlled vision systems, which are highly sensitive to imprint variations not perceptible to the naked eye. Other applications are related to marketing materials, which also require high quality imprints. The existing typeholders, however, tend to produce imprints having a rejection rate that is unacceptable in many applications, which results in waste, production inefficiency and unnecessary expense.

In view of the discussion above among other considerations, there exists a demonstrated need for an advancement in the art of imprinting systems with a typeholder for holding variable type.

It is therefore an object of the invention to provide a novel imprinting system with a typeholder that overcomes problems in the prior art.

It is also an object of the invention to provide a novel imprinting system with a typeholder that produces high quality, consistently accurate imprints.

It is another object of the invention to provide a novel imprinting system with a variable typeholder that prevents type disposed and retained within the typeholder cavity from shifting.

It is another object of the invention to provide a novel imprinting system with a typeholder that is readily diposeable in and removable from a recess in a print head without tools or disassembly.

It is a further object of the invention to provide a novel imprinting system with a typeholder that is firmly retained in a recess of a print head.

It is yet another object of the invention to provide a novel imprinting system with a typeholder that is positively located along an insertion axis of a recess in a print head by a striker plate, wherein the typeholder is securely retained along the insertion axis of the recess by a magnetic field.

It is still another object of the invention to provide a novel imprinting system with a typeholder that is firmly retained within a recess of a print head and prevented from moving laterally relative an insertion axis of the recess by a button biased toward and into engagement with the recess.

These and other objects, features and advantages of the present invention will become more fully apparent upon consideration of the following Detailed Description of the Invention with the accompanying Drawings, which may be disproportionate for ease of understanding, wherein like structure and steps are referenced by corresponding numerals and indicators.

DETAILED DESCRIPTION OF THE INVENTION

Figure 1:
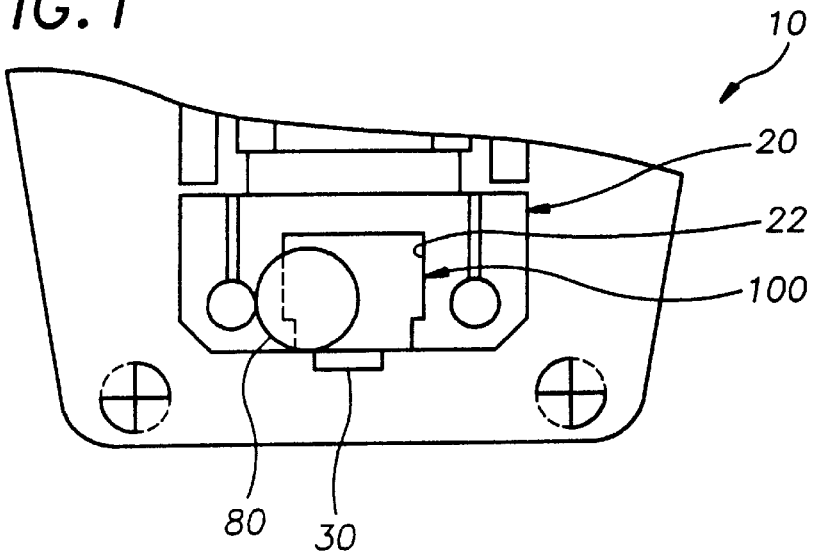
FIG. 1 is a partial sectional view of a print head having a heater block for receiving a removable typeholder with a typeface according to an exemplary embodiment of the invention.
Figure 2A:
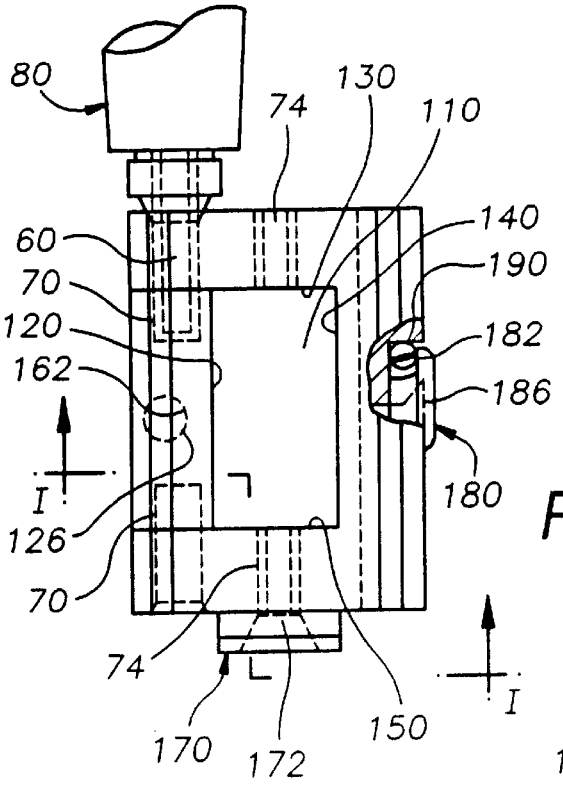
FIG. 2*a* is a partial plan view of an exemplary variable typeholder with a variable typeface, illustrating several features of the invention.
Figure 2B:
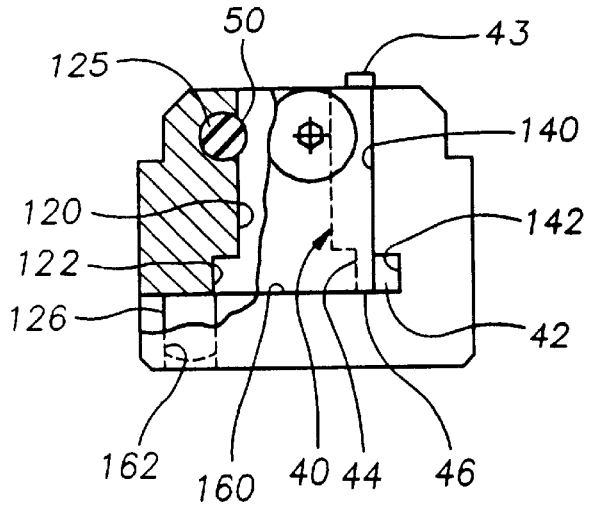
FIG. 2*b* is a partial sectional view taken along lines I—I of the typeholder in FIG. 2*a*.

FIG. 1 is a partial elevation view of a printing system 10 including generally a print head 20 having a cavity or recess 22 for housing a typeholder 100 with typeface 30 comprised of a plurality of type 40, shown in phantom in FIG. 2*b*, for transferring ink from an inked ribbon onto a substrate, which are not shown in the drawing. The exemplary embodiment of FIG. 1 is a hot stamp imprinter wherein the typeholder 100 is disposed in a recess 22 of a heater block of the print head 20, which transfers heat to the typeholder 100. In many applications, the typeholder 100 is removably disposeable in the recess 22 of the print head 20 to facilitate typesetting.

FIGS. 2*a* and 2*b* show the typeholder 100 having an open ended cavity 110 defined by side walls 120, 130, 140 and 150, and a base portion 160. At least a portion of one of the side walls, and in the exemplary embodiment side wall 120, is removably coupleable to the typeholder 100 for permitting insertion of type into the cavity 110. FIG. 2*b* shows the side wall 140 having a recess 142 for receiving a foot portion 42 of the type 40, wherein the recess 142 retains the type 40 in the cavity 110. The opposite side wall 120 has a similar recess 122 for receiving a foot portion 42 of the type 40 and retaining the type 40 in the cavity, so that the type image can be arranged alternatively in the cavity 180 degrees to face the opposite direction. The type 40 may or may not include a type surface 43 protruding from the cavity 110 to form the typeface 30. In any case, the cavity 110 is filled with a plurality of type 40 arranged side by side and in one or more adjacent rows to form an array. Shims or blank type having a similar foot configuration may also be combined with the type to fill the cavity. The type feet in the adjacent rows, not shown, are received in a recess 44 formed in the adjacent row of type 40. The plurality of type 40 is retained between the opposing side walls 130 and 150, and also between opposing side walls 120 and 140 when the removably coupleable portion of side wall 120 is assembled to the typeholder 100. A bottom portion 46 of the type 40 is supportable along the base portion 160 of the typeholder 100. In other embodiments, the typeholder 100 may be configured to retain type 40 having other retention configurations.

According to another aspect of the invention, a resilient member 50 protrudes into the cavity from at least one of the side walls to bias the plurality of type toward one of the other opposing side walls to prevent shifting of the plurality of type 40 in the cavity 110. In the exemplary embodiment of FIGS. 2*a* and 2*b*, the resilient member 50 extend along side wall 120. In other embodiments, it may be advantageous to include a resilient member 50 protruding from at least one of each pair of opposing side walls, for example from side walls 120 and 130. And in still other embodiments, it may be advantageous to include a resilient member 50 protruding from each side wall. FIG. 2*b* shows a resilient member 50 as an elongate member partially disposed in a recess 125 along side wall 120 and protruding therefrom into the cavity 110. The resilient member 50 is dimensioned so that it is engageable with all of the type 40 disposed in a given row in the cavity 110, and thus need not extend the entire dimension of the cavity 100. In one embodiment, the resilient member 50 is fabricated from an O-ring material like fluorocarbon, also known as VITON available from Minnesota Rubber, Compound No. 514AD. This material is heat resistant at temperatures between approximately 250 and 400 degrees Fahrenheit. Other sectional shapes, and other materials having similar resilience and heat resistance properties may be used in alternative embodiments.

According to another aspect of the invention, the base portion 160 of the cavity includes an aperture 162, and the removably coupleable side wall 120 includes an anchoring member, or stud, 126 protruding from a bottom portion of the side wall 120. The stud 126 is disposeable in the aperture 162 of the cavity base portion 160 when the side wall 120 is assembled or coupled to the typeholder 100. The stud 126 positively positions the removably coupleable side wall 120 and prevents lateral movement of the side wall 120 away from the type 40 under the action of the resilient member 50. A fastening member 60, like a threaded member, is engageably disposeable into an aperture 70 that extends through an adjacent side wall 130 or 150, or both, and into the removably coupleable side wall 120 to securely couple the removable side wall 120 to the typeholder 100. In the exemplary embodiment, the fastening member 60 extends from a handle 80, wherein the handle 80 is coupleable to either side of the typeholder 100. According to this configuration, the typeholder 100 is readily disassembleable for changing the type 40 by simply unscrewing the handle 80 from the typeholder and removing the side wall 120, whereupon the type 40 and the cavity are readily accessible for typesetting. In another embodiment, the bore 162 is extended through the base 160 of the typeholder 100 to permit pushing on the stud 126 with the fastening member 60 of the handle 80, or some other object, to further facilitate separation of the removable side wall 120 from the typeholder 100.

According to another aspect of the invention, a striker plate 170 is disposed on an outer surface of the typeholder 100. In the exemplary embodiment, the striker plate 170 is disposed on an outer side surface opposite the handle 80 wherein the striker plate 170 is engageable with a portion of the print head 20 when the typeholder 100 is fully disposed in the recess 22 of the print head 20. In the exemplary embodiment, the striker plate 170 is coupled to the typeholder 100 by a bolt 172 engageably disposed in a threaded bore 74 of the typeholder 100. The striker plate 170 may be coupled to the bore 74 located on either side of the typeholder 100, as may the handle 80, to accommodate alternative imprinter system configurations. According to a related aspect of the invention, the striker plate 170 has a magnetized portion which is magnetically attractable to, or interactable with, a magnetized or metal portion of the print head 20 to positively retain the typeholder 100 in the recess 22 of the print head, thereby eliminating the requirement for any extraneous fastening means. The striker plate 170 thus positively positions the typeholder 100 along the insertion axis of the recess 22, and the magnetized portion of the striker plate 170 securely retains the typeholder 100 along the insertion axis. The readily replaceable striker plate 170 is formed of a relatively hard material compared to the typeholder side walls thereby reducing wear on these portions of the typeholder.

According to yet another aspect of the invention, a button 180 protrudes from an outer surface of the typeholder 100 and is frictionally engageable with a wall portion of the recess 22 in the print head 20 to prevent movement of the typeholder 100 disposed in the recess 22 of the print head 20. In the exemplary embodiment, the button 180 is disposed on one of the lateral outer side portions of the typeholder 100 to compensate for any space between the recess 22 and the outer surface of the typeholder 100. The button 180 thus prevents the tendency of the typeholder 100 to move laterally and longitudinally relative to the insertion axis of the recess 22 of the print head 20, and firmly retains the typeholder 100 in the recess 22. A second resilient member 182 is disposed between the button 180 and the outer surface of the typeholder 100 to urge, or bias, the button 180 into contacting engagement with the wall portion of the recess 22 in the print head 20. In one embodiment, the resilient member 182 is an O-ring made from fluorocarbon, also known as VITON available from Minnesota Rubber, Compound No. 514AD, and the button 180 is made from a heat resistant material like FLUOROSINT 500. In the exemplary embodiment, the resilient member 182 and the button 180 are at least partially disposed and retained in a recess 190 of the typeholder 100 by a screw 186. The screw 186 is preferably recessed below an outer surface of the button 180 to prevent contact with the recess 22 of the print head 20. And the screw 186 is adjustable to vary the extent that the button protrudes from the outer surface of the typeholder 100 to accommodate different gaps widths between the typeholder 100 and the recess 22, and also to compensate for wear on the button 180.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A typeholder for retaining a plurality of type and useable in an imprinting system having a print head for transferring ink from an inked ribbon onto a substrate, the typeholder comprising:

an open ended cavity defined by side walls, a cavity retaining the plurality of type;

at least one side wall portion removably coupleable to the typeholder for permitting insertion of the plurality of type into the cavity; and an elongate resilient member disposed partially in a recess formed along the at least one side wall portion removably coupleable to the typeholder, the elongate resilient member protruding into the cavity and engaging the plurality of type and biasing the plurality of type toward one of the other side walls to prevent shifting of the plurality of type in the cavity.

2. The typeholder of claim 1, the elongate resilient member is at least partially cylindrical, and the recess is elongate and at least partially cylindrical for retaining a portion of the elongate at least partially cylindrical resilient member.

3. A typeholder for retaining a plurality of type and useable in an imprinting system having a print head for transferring ink from an inked ribbon onto a substrate, the typeholder comprising:

an open ended cavity defined by side walls and a base portion with an aperture, the cavity retaining the plurality of type;

at least one side wall portion removably coupleable to the typeholder for permitting insertion of the plurality of type into the cavity, the removably coupleable side wall portion having an anchoring member protruding from a bottom portion of the removably coupleable side wall portion, the anchoring member disposeable into the aperture of the cavity base portion when the removably coupleable side wall portion is coupled to the typeholder.

4. The typeholder of claim 3 further comprising a handle having a fastening member disposable through one of the side walls and engageable with the removably coupleable side wall portion, whereby the fastening member retains the removably coupleable side wall portion coupled to the typeholder.

5. The typeholder of claim 3, the aperture of the base portion extending through the base portion, whereby the anchoring member is accessible and ejectable from the aperture of the base portion.

6. The typeholder of claim 3, further comprising a resilient member protruding into the cavity from at least one of the side walls, the resilient member engaging at least one of the plurality of type and biasing the plurality of type toward one of the other side walls to prevent shifting of the plurality of type in the cavity.

7. An imprinting system having a print head with a plurality of type for transferring ink from an inked ribbon onto a substrate, the system comprising:

a typeholder having an open ended cavity defined by side walls, the cavity retaining the plurality of type, the typeholder removably disposeable in a recess of the print head; and a button protruding from an outer surface of the typeholder, the button engageable with the recess in the print head when the typeholder is disposed in the recess of the print head to prevent movement of the typeholder within the recess of the print head.

8. The system of claim 7 further comprising a resilient member disposed between the button and the outer surface of the typeholder, the resilient member and the button at least partially disposed in a recess of the typeholder, wherein the resilient member biases the button into contact with the recess of the print head when the typeholder is disposed in the recess of the print head.

9. The system of claim 7 further comprising a striker plate disposed on an outer surface of the typeholder, the striker plate having a magnetized portion, wherein the magnetized portion of the striker plate interacts with the print head to retain the typeholder in the recess of the print head.

10. The system of claim 7, at least one side wall portion of the typeholder removably coupleable to the typeholder for permitting insertion of the plurality of type into the cavity.

11. The system of claim 7 further comprising a resilient member protruding into the cavity from at least one of the side walls, the resilient member engaging at least one of the plurality of type and biasing the plurality of type toward one of the other side walls to prevent shifting of the plurality of type in the cavity.

* * * * *